US005382292A

United States Patent [19]

Conroy et al.

[11] Patent Number: 5,382,292

[45] Date of Patent: Jan. 17, 1995

[54] EDGE GUIDE LUBRICATING FLUID DELIVERY APPARATUS

[75] Inventors: James E. Conroy; Kenneth J. Ruschak; William D. Devine, all of Rochester, N.Y.

[73] Assignee: Eastman Kodak Company, Rochester, N.Y.

[21] Appl. No.: 98,589

[22] Filed: Jul. 28, 1993

[51] Int. Cl.[6] ..... B05D 1/30

[52] U.S. Cl. ..... 118/324; 118/DIG. 4

[58] Field of Search ..... 118/300, DIG. 4, 325, 118/324; 427/420, 402

[56] References Cited

U.S. PATENT DOCUMENTS

| | | | |
|---|---|---|---|
| 3,508,947 | 4/1970 | Hughes | 117/34 |
| 4,075,976 | 2/1978 | Clayton | 118/324 |
| 4,135,477 | 1/1979 | Ridley | 118/325 |
| 4,267,795 | 5/1981 | Reba | 118/302 |
| 4,479,987 | 10/1984 | Koepke et al. | 427/402 |
| 4,510,882 | 4/1985 | Prato | 118/300 |
| 4,974,533 | 12/1990 | Ishizuka et al. | 118/411 |

OTHER PUBLICATIONS

H. Schlichting, *Boundary Layer Theory,* pp. 185–187, (1987).

M. G. Antoniades, R. Godwin, S. P. Lin, *Journal of Colloid and Interface Science,* vol. 77, No. 2, pp. 583–585, (Oct. 1980).

D. J. Tritton, *Physical Fluid Dynamics,* p. 12, (1982).

*Perry's Chemical Engineers' Handbook Sixth Edition,* pp. 5–35, (1984).

*Primary Examiner*—W. Gary Jones
*Assistant Examiner*—Brenda Adele Lamb
*Attorney, Agent, or Firm*—Carl F. Ruoff

[57] ABSTRACT

The present invention is an apparatus for guiding the edge of a free-falling curtain. The apparatus includes first and second slides positioned at the top of the curtain which merge. An edge guide is positioned at the point where the slides merge. A lubricating liquid is provided to each slide surface which flows down each slide and the edge guide to guide the edge of the free-falling curtain. The present invention allows time for surfactant in the lubricating liquid time to diffuse to the surface and promotes dampening of disturbances in the lubricating liquid.

13 Claims, 2 Drawing Sheets

EDGE GUIDE LUBRICATING FLUID DELIVERY APPARATUS

TECHNICAL FIELD OF THE INVENTION

The present invention relates to a method and apparatus for coating objects or moving supports advancing continuously through a coating station with a free-falling curtain of coating liquid. More particularly, the present invention relates to a curtain coating method and apparatus for the manufacture of photographic film and paper.

BACKGROUND OF THE INVENTION

In a coating apparatus of the curtain coating type, a moving support is coated by causing a free falling curtain of coating liquid, referred to hereafter as simply the curtain, to impinge on a moving support to form a layer thereon. An apparatus to perform this method is described in U.S. Pat. No. 3,508,947 to Hughes wherein a multilayer composite of a plurality of distinct liquids is formed on a slide hopper and dropped therefrom to form a falling curtain.

In the curtain coating process, particularly as used to manufacture multilayer photographic materials, the quality of the coating is largely determined by the properties of the liquid curtain. It is important to ensure that a stable laminar flow of coating solution is formed by the slide hopper and that an equally stable laminar liquid curtain is formed from that coating solution. To prevent contraction of the edges of the falling curtain under the effect of surface tension it is known that the curtain must be guided at its edges by curtain edge guides.

It is well known in the curtain coating art that introduction of a lubricating liquid between the curtain and the edge guide will improve the operation of the curtain. These improvements include the ability to maintain the curtain at lower total flow rates with lubricating liquid than without, and the ability to maintain curtains of higher viscosity with a lubricating liquid than without. Typically, the lubricating liquid is simply water; however, an alternate liquid of low viscosity may be used for the same purpose.

Surfactants are typically added to the outer layers of the multiple layer curtain coating application. As the layers flow down the hopper slide the surfactant has some time to diffuse from the bulk of the liquid to the surface and lower the surface tension of the top layer. When the lubricating liquid is introduced abruptly its initial surface tension is unavoidably high compared to the curtain even if there is surfactant added since there is no time for surfactant diffusion. This creates a surface-tension-driven flow which moves some of the high viscosity curtain solutions to the edge guide. This increases the effective viscosity near the edge guide and thereby increases wall drag. This increased wall drag reduces the momentum of the edge of the curtain and in turn limits coating speed and compromises the uniformity of the edge thereby causing waste.

The present invention provides a method for issuing a lubricating band of liquid along an edge guide with a surface tension similar to the curtain solution and without disturbance to the curtain. This is accomplished in a very short vertical distance from the lip, thus maximizing the velocity of the curtain solutions near the edge. The lubricating fluid band is also in laminar flow, thus avoiding wavy edge and turbulent wave problems caused by turbulent edge solution flow.

SUMMARY OF THE INVENTION

The present invention is an apparatus for laterally guiding an edge of a free-falling curtain. The apparatus includes an inlet duct positioned near the top of the free-falling curtain, the inlet duct terminating at a first end and a second end. The first end is in front of a plane of the curtain and the second end is in back of the plane of the curtain. The apparatus includes a first slide surface joining the first end of the inlet duct and a second slide surface joining the second end of the inlet duct wherein the first and second slide surfaces are angled downwardly towards each other. An edge guide is positioned at the bottom of the first and second slide surfaces. A means for providing lubricating liquid to the inlet duct is included.

For a better understanding of the present invention together with other and further advantages and capabilities thereof, reference is made to the following disclosure and claims in connection with the above-described drawings.

DETAILED DESCRIPTION OF THE PREFERRED EMBODIMENTS

Figure 1:
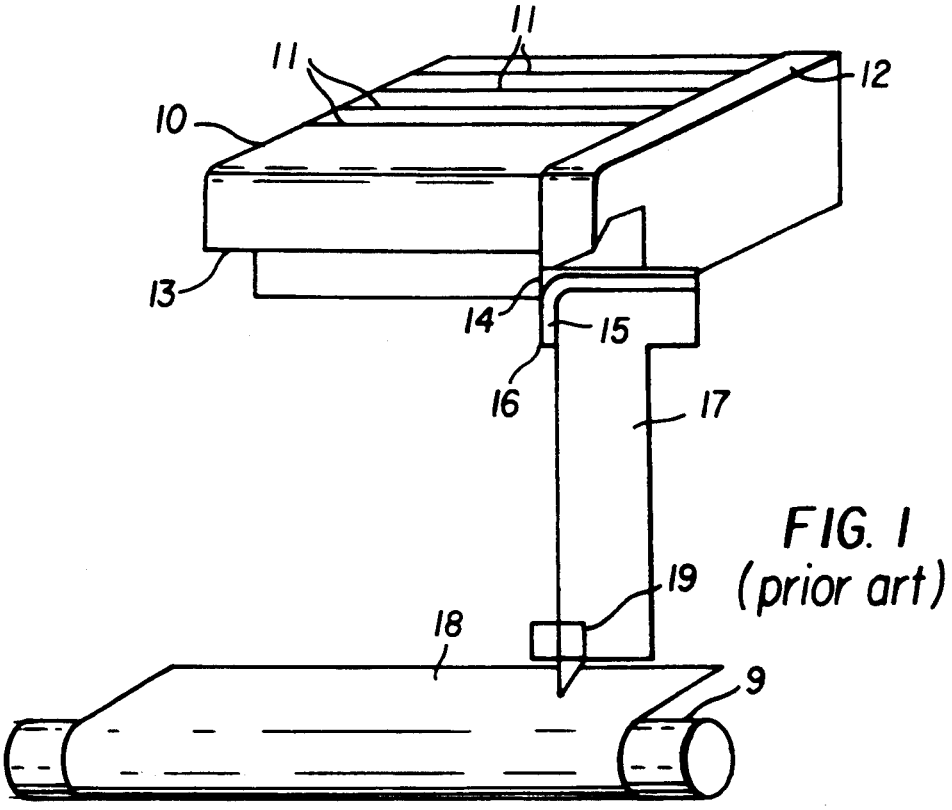
FIG. 1 (prior art)
FIG. 1 shows a simplified schematic perspective view of the curtain coating edging process.

FIG. 1 shows a simplified perspective view of the curtain coating edging process using a prior art edge guide. Typically there is an edge guide on each side of the hopper, however only one edge guide is shown in FIG. 1. In the curtain coating process, a coating hopper 10 delivers liquid layers (not shown) from a series of slots 11 which eventually form a falling curtain (not shown). The liquid layers flow over each other down the hopper slide to form a free-falling curtain. The liquid is constrained on the coating hopper 10 by an edge pad 12. When the liquid leaves the hopper lip 13 it forms a curtain. The edge of the curtain will come in contact with a non-lubricated portion 14 of the edge guide 17. After falling a short distance the curtain then comes into contact with the lubricating liquid delivered through lubricating liquid duct 15. Typically, the lubricating fluid is simply water, however, an alternate fluid of low viscosity may be used for the same purpose. After the curtain meets the lubricating fluid at transition area 16, the edge of the curtain is then guided by edge guide 17 to the support 18. A liquid removal means 19 positioned at the bottom of edge guide 17 removes the lubricating liquid prior to the curtain being coated on the support 18. The support 18 is conveyed through the coating curtain by coating roll 9.

Figure 2:
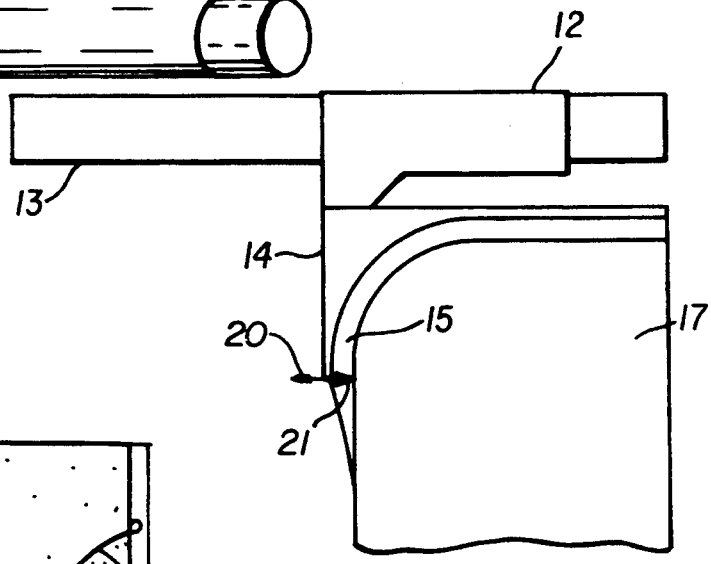
FIG. 2 (prior art)
FIG. 2 shows the surface tension flow which occurs with a prior art edge guide.

Surfactants are typically added to the outer layers of the multiple layer curtain coating application. As the layers flow down the hopper slide, the surfactant has some time to diffuse from the bulk of the liquid to the surface and lower the surface tension of the top layer. When the lubricating liquid is introduced abruptly as shown in FIG. 1, its initial surface tension is unavoidably high compared with the curtain even if there is surfactant added since there is no time for surfactant diffusion. This creates a surface tension driven flow which moves some of the high viscosity curtain solutions towards the edge guide. This increases the effective viscosity near the edge guide and thereby increases wall drag. FIG. 2 shows surface tension flow which occurs if the lubrication fluid is introduced abruptly. Arrow 21 indicates the pull of the surface tension of the lubricating liquid and arrow 20 indicates the pull of the surface tension of the coating solutions of the curtain. In FIG. 2, arrow 21 is longer than arrow 20 indicating the higher tension of the lubricating liquid.

FIG. 2 is a frontal view showing the hopper lip 13 and the top portion of the edge guide 17. The edge pad 12 ends a few millimeters below the hopper lip 13 where it joins the edge wall 14 of the edge guide 17. The thickness of the edge pad and edge wall where the curtain is joined are comparable to the thickness of the curtain. Lubricating liquid in laminar flow is introduced onto the guide as close to the hopper lip as possible, so that the unlubricated length of the curtain's edge is minimized. The dimensions for the outlet for the lubricating liquid and the thickness of the edge guide where the curtain is contacted are also chosen to be of the same magnitude as the local curtain thickness. Ideally, the lubricating liquid completely separates the curtain from the edge guide; but, because the surface tension of the lubricating liquid is likely to be higher than that of the curtain, the surface of the lubricating liquid contracts and draws some of the higher viscosity curtain composition toward the edge guide. The desired lubricating effect is thereby diminished.

If the merging of the lubricating liquid and curtain solution at the outlet point of the lubricating fluid delivery apparatus creates a disturbance to the curtain, the uniformity of the coating near the edge will be compromised. Therefore it is important that the lubricating fluid delivery apparatus be designed so that the transition of the curtain from joining a solid non-lubricated wall to joining the lubricated edge guide is very smooth. A disturbance to the natural path desired by the curtain can result in a wave in the curtain. A stationary disturbance such as an irregular geometry, an abrupt change in edging geometry, contamination on the edge guide, or a multitude of other possibilities can result in direct disruption of the coating compositions or a standing wave in the curtain. A moving disturbance such as turbulent lubricating liquid flow down an edge guide can result in direct disruptions and waves that are stationary if the disturbance is stationary or moving with the liquids if the disturbance moves with the liquids.

Figure 3:
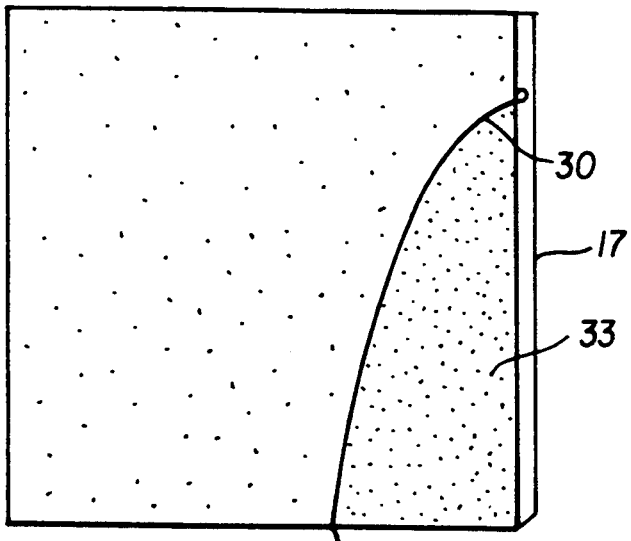
FIG. 3 (prior art)
FIG. 3 shows a standing wave resulting from a disturbance on an edge guide.

FIG. 3 shows a schematic of a standing wave. A standing wave 30 results in a longitudinal streak 31 being seen at the same position on the support (not shown). A traveling wave results in a streak which starts some distance from the edge of the support and moves towards the edge. As well as causing a streak at the point where they strike the support, waves can also redistribute fluid in the entire area underneath them as shown in zone 33 in FIG. 3. This causes the uniformity of the coating to vary from the edge to the wave.

The present invention is a device by which a lubricating band of fluid is introduced along an edge guide delivered by two external slides which merge at the edge guide. The slides are directed downward but are not necessarily vertical, with one slide issuing at an angle towards the front of the curtain and one slide issuing toward the back of the curtain. The resulting shape is a V with each leg of the V representing a slide and the bottom of the V being where they merge and join the edge guide. It is not necessary for the two slides to join at a point.

The present invention facilitates the addition of surfactant to the lubricating liquid. The spreading of the curtain liquid over the lubricating liquid can be minimized by adding surfactant, thereby keeping drag to a minimum and curtain uniformity to a maximum. The invention allows surfactant the necessary time to move to the surface of the lubricating fluid and to reduce the surface tension of the lubricating liquid before it meets the curtain edge. This permits the surface tension of the curtain and lubricating fluid to be balanced at the point where the lubricating fluid and curtain solution merge, thus eliminating the undesirable effects of surface tension driven flow of the curtain and lubricating fluids at the edge guide.

This design provides a very smooth transition to the edge of the curtain as it travels from the solid wall of the edge guide to the lubricated portion of the edge guide. It also minimizes the distance the curtain must travel along a non-lubricated wall before merging with the lubricated edge guide while insuring that the lubricated fluid flow is laminar. As the lubricating fluid flows down the slides, disturbances in the flow dampen, particularly where the lubricating fluid contains surfactant.

At the point where the lubricating fluid issues into the curtain, the two slides also merge forming one band of lubricating fluid along the edge guide. The merging of the two fluid slides and the curtain results in a very smooth, disturbance-free transition for the curtain solution.

Figure 4:
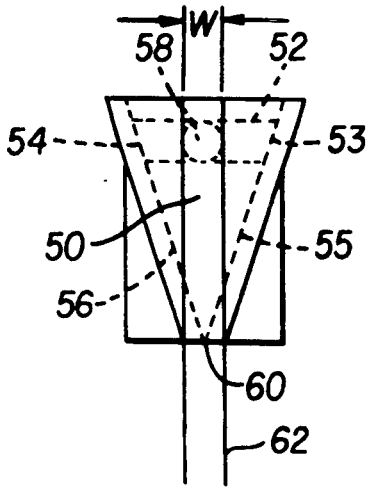
FIG. 4 is a side view of the lubricating liquid inlet apparatus of the present invention.
Figure 5:
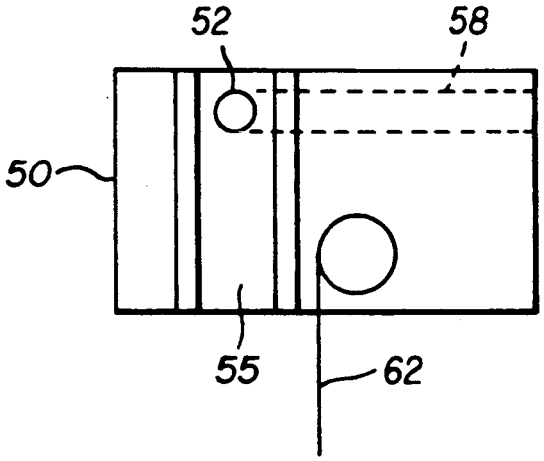
FIG. 5 is a front view of the lubricating liquid inlet apparatus of the present invention.
Figure 6:
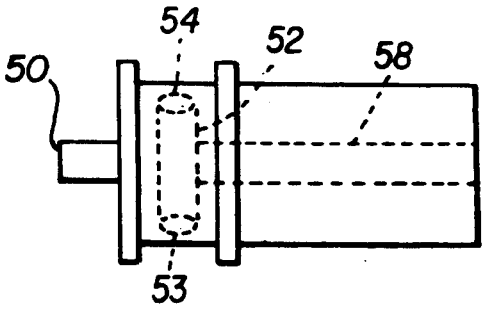
FIG. 6 is a top view of the lubricating liquid inlet apparatus of the present invention.
Figure 7:
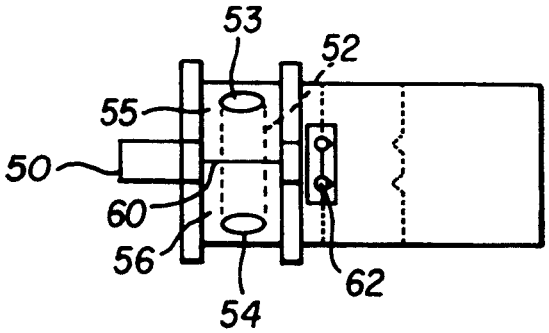
FIG. 7 is a bottom view of the lubricating liquid inlet of the present invention.

FIGS. 4–7 show various views of the lubricating liquid delivery apparatus of the present invention. FIG. 4 shows a view from the curtain perspective, that is looking along the plane of the curtain. The width W of the edge wall 50 for the curtain should be close to the thickness of the curtain in order to provide the most uniform coating possible. If this wall 50 is much wider than the curtain, the air interfaces will be non-planar and a non-uniformity will result in the coating. The lubricating liquid is introduced through a duct 52. The duct 52 terminates at a front 53 of the curtain and a back 54 of the curtain. These termination points 53 and 54 join the slide surfaces 55 and 56. Lubricating liquid is provided to the delivery duct 52 through a delivery tube 58 (see FIGS. 5 and 6) although other means are possible. The two slide surfaces 55 and 56 merge at a point 60. At this point 60, the lubricating liquid comes in contact with the edge guide 62. Shown in FIG. 4 is the dual-wire edge guide described in U.S. patent application Ser. No. 07/979,504 filed on Nov. 19, 1992. This application is incorporated by reference herein. It is also possible to use other edge guides as described in U.S. patent application Ser. No. 07/979,720 filed on Nov. 20, 1992. This application describes a tapered edge plate as an edge guide. FIG. 7 shows a bottom view of the delivery apparatus looking up from the support.

Figure 8:
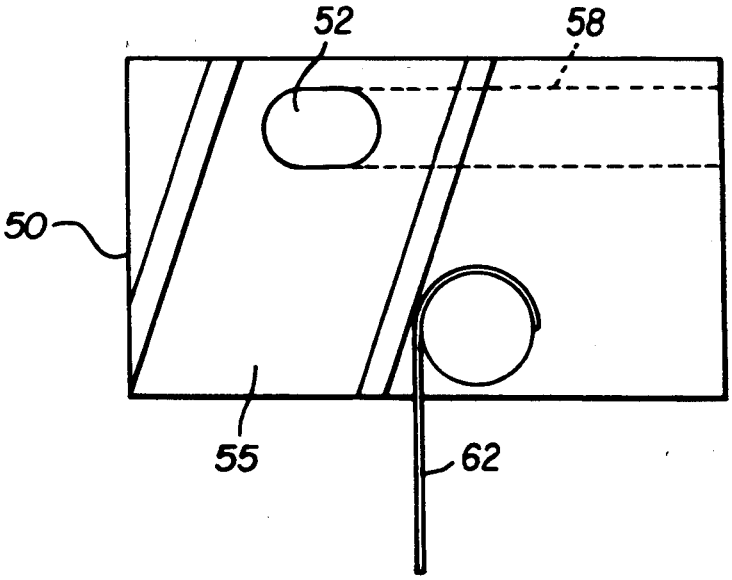
FIG. 8 is a front view of an alternate embodiment of the lubricating liquid inlet of the present invention.

FIG. 8 shows an alternate embodiment of the lubricating fluid apparatus of the present invention. In this embodiment, the surface slide is angled toward the curtain thereby eliminating the gap between where the lubricating fluid issues and where the curtain merges. This merger is critical since, if there is a significant disturbance at this point the uniformity of the edges of the coating may be compromised.

EXAMPLE

A lubricating liquid delivery apparatus was constructed according to FIG. 8. Each slide surface (only slide surface 55 is shown in FIG. 8) had a width of 0.075 inches and a length of 0.455". The slides were inclined at an angle of 15° to the vertical in both the plane of the curtain and in the plane normal to the curtain. The unlubricated edge wall 50 had a width of 0.06 inches and a length of 0.575 inches. There was no gap between the bottom ends of the slide and the edge wall 50. The edge guide was two tungsten wires 0.006 inches in diameter which were parallel and spaced 0.020 inches apart in a vertical plane which is normal to the curtain. The solid surfaces separating the ends of the slide surfaces was about 0.04 inches wide.

This lubricating liquid delivery means was used to form a 5 layer curtain of aqueous bone gelatin. The properties of each of the 5 layers are shown in Table 1.

TABLE 1

| layer | viscosity, cp | flow, cc/s/cm | surfactant |
|---|---|---|---|
| top | 41 | 0.18 | yes |
| 4 | 41 | 0.37 | no |
| 3 | 20 | 0.68 | no |
| 2 | 41 | 0.37 | no |
| bottom | 41 | 0.36 | yes |

Each layer in Table 1 contained the same concentration of a dispersion of carbon black to aid in the visual evaluation of curtain uniformity. The lubricating liquid was water containing low concentrations of magenta dye for visibility and a small amount of glycerol to raise the viscosity to 0.8 cp at 105° F. The flowrate of the lubricating liquid was 35 cc/min per edge guide. With no surfactant in the lubricating liquid, the two surfaces of the curtain spread over the surfaces of the lubricating liquid where the lubricating liquid contacts the main curtain. The color of the lubricating liquid darkened as a result of the migration of the black curtain composition to the wire guide. By adding surfactant to the lubricating liquid at a level comparable to that in the top and bottom layers of the main curtain, the spreading was stopped and the lubricating liquid remained a clear band adjacent to the wire guide.

While there has been shown what are presently considered to be the preferred embodiments of the invention various modifications and alterations will be obvious to those skilled in the art. All such modifications are intended to fall within the scope of the appended claims.

What is claimed:

1. An apparatus for laterally guiding an edge of a falling curtain comprising:
   an inlet duct positioned near a top of the free-falling curtain terminating at a first end and a second end, the first end in front of a plane of the curtain and the second end in back of the plane of the curtain;
   a first slide surface joining the first end of said inlet duct;
   a second slide surface joining the second end of said inlet duct wherein said first and second slide surfaces are angled downwardly towards each other;
   an edge guide positioned at a bottom of said first and second slide surfaces; and
   fluid providing means for providing lubricating liquid to said inlet duct.

2. The apparatus according to claim 1 further comprising:
   liquid removal means positioned at a bottom of said edge guide.

3. The apparatus according to claim 1 wherein the lubricating liquid comprises surfactant.

4. The apparatus according to claim 1 wherein said edge guide comprises a pair of wires.

5. The apparatus according to claim 1 wherein said edge guide comprises a planar surface.

6. An apparatus for curtain coating a support by depositing one or more coating liquids onto the support comprising:
   conveyor means for moving said support along a path through a coating zone;
   hopper means for forming one or more layers of coating liquids to form a free falling curtain which extends transversely of said path and impinges on said moving support;
   edge guide means spaced a distance apart for laterally guiding said falling curtain;
   liquid distributing means for issuing a lubricating liquid from said edge guide means to maintain wetting contact with said falling curtain said liquid distributing means comprising:
      an inlet duct positioned near a top of the free-falling curtain, said inlet duct terminating at a first and second end, the first end in front of a plane of the falling curtain and the second end in back of the plane of the falling curtain;
      a first slide joining the first end of said inlet duct;
      a second slide joining the second end of said inlet duct; and
      wherein said first and second slides angle towards each other and terminate at the edge guide means whereby lubricating liquid issuing from the first and second end of said inlet duct flows down said first and second slides and said edge guide means.

7. The apparatus according to claim 6 further comprising:
   liquid removal means for removing liquid from the bottom of said edge guide means.

8. The apparatus according to claim 6 wherein the lubricating liquid comprises surfactant.

9. An apparatus for laterally guiding an edge of a free-falling curtain comprising:
   a first slide having a first end and a second end positioned near a top of the free-falling curtain, the first end of said first slide beginning in front of the plane of the curtain and, said first slide being angled toward the curtain;
   a second slide having a first end and a second end positioned near a top of the curtain, the first end of said second slide beginning in back of the plane of the curtain and, second slide being angled toward the curtain wherein the second end of said first slide and the second end of said second slide merge;

an edge guide positioned where said first and second slides merge; and liquid providing means for providing lubricating liquid to said first and second slides.

10. The apparatus according to claim 9 further comprising:

liquid removal means positioned at a bottom of said edge guide.

11. The apparatus according to claim 9 wherein the lubricating liquid comprises surfactant.

12. The apparatus according to claim 9 wherein said edge guide comprises a pair of wires.

13. The apparatus according to claim 9 wherein said edge guide comprises a planar surface.

* * * * *